US008396402B2

(12) United States Patent
Mizumoto

(10) Patent No.: US 8,396,402 B2
(45) Date of Patent: Mar. 12, 2013

(54) CONDUCTIVE ROLLER

(75) Inventor: Yoshihisa Mizumoto, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 623 days.

(21) Appl. No.: 12/569,667

(22) Filed: Sep. 29, 2009

(65) Prior Publication Data

US 2010/0143008 A1 Jun. 10, 2010

(30) Foreign Application Priority Data

Dec. 4, 2008 (JP) ..... 2008-310295

(51) Int. Cl.
*G03G 15/08* (2006.01)

(52) U.S. Cl. ..... 399/286; 399/281; 399/279; 399/265

(58) Field of Classification Search ..... 399/281, 399/279, 265, 286
See application file for complete search history.

(56) References Cited

U.S. PATENT DOCUMENTS

| | | | | |
|---|---|---|---|---|
| 5,666,626 | A * | 9/1997 | Takizawa et al. | 399/286 |
| 6,454,688 | B1 * | 9/2002 | Okuda et al. | 492/56 |
| 2006/0039721 | A1 * | 2/2006 | Shiomura et al. | 399/286 |
| 2007/0254792 | A1 * | 11/2007 | Mizumoto | 492/53 |

FOREIGN PATENT DOCUMENTS

| | | | |
|---|---|---|---|
| JP | 2004-170845 | A | 6/2004 |
| JP | 2005-225969 | A | 8/2005 |
| JP | 02005292633 | * | 10/2005 |
| JP | 2006-99036 | A | 4/2006 |
| JP | 2007-72445 | A | 3/2007 |
| JP | 2007-286236 | A | 11/2007 |
| JP | 2007-291298 | A | 11/2007 |
| JP | EP001887050 | A1 * | 2/2008 |

* cited by examiner

*Primary Examiner* — Walter L Lindsay, Jr.

*Assistant Examiner* — Roy Y Yi

(74) *Attorney, Agent, or Firm* — Birch, Stewart, Kolasch & Birch, LLP

(57) ABSTRACT

The present invention provides a conductive roller having a toner transport part composed of a vulcanized rubber composition at least on an outermost layer thereof. The vulcanized rubber composition contains a rubber component (A), highly conductive carbon black (B) having a particle diameter not less than 18 nm and less than 80 nm, an inorganic filler (C) consisting of not less than one kind of a metal oxide selected from among a group of titanium oxide, alumina, and silica. A total of a content of the highly conductive carbon black (B) and a content of the inorganic filler (C) for 100 parts by mass of the rubber component (A) is not less than 10 parts by mass nor more than 60 parts by mass.

6 Claims, 1 Drawing Sheet

CONDUCTIVE ROLLER

This nonprovisional application claims priority under 35 U.S.C. §119(a) on Patent Application No(s). 2008-310295 filed in Japan on Dec. 4, 2008, the entire contents of which are hereby incorporated by reference.

BACKGROUND OF THE INVENTION

1. Field of the Invention

The present invention relates to a conductive roller and more particularly to a conductive roller, having a toner transport part, which is used as a developing roller, a cleaning roller, a charging roller, a transfer roller, and the like to be mounted on an electrophotographic apparatus.

2. Description of the Related Art

In the printing technique using an electrophotographic method, improvements have been made to satisfy demands for a high-speed printing operation, formation of a high-quality image, formation of a color image, and miniaturization of an image-forming apparatus. Toner holds the key to these improvements. To satisfy the above-described demands, it is necessary to form finely divided toner particles, make the diameters of the toner particles uniform, and make the toner particles spherical.

Regarding the technique of forming the finely divided toner particles, toner having a diameter not more than 10 μm and not more than 5 μm have been developed recently. Regarding the technique of making the toner spherical, toner having not less than 99% in its sphericity has been developed. To form the high-quality image, polymerized toner has come to be widely used instead of pulverized toner conventionally used. The polymerized toner allows the reproducibility of dots to be excellent in obtaining digital information as a printed sheet and hence a high-quality printed sheet to be obtained.

In compliance with the improvement in the technique of forming the finely divided toner particles, making the diameters of the toner particles uniform, making the toner particles spherical, and the shift from the pulverized toner to the polymerized toner, a conductive roller is especially useful as a developing roller which imparts a high charging property to toner and is capable of efficiently transporting the toner to a photosensitive drum in an image-forming mechanism of an electrophotographic apparatus such as a laser beam printer, and the like. Users demand that the high-performance function of the conductive roller is maintained to the end of the life of a product.

To comply with the above-described demand, the present applicant proposed a semi-conductive rubber member, as described in Japanese Patent Application Laid-Open No. 2007-286236 (patent document 1). The semi-conductive rubber roller is composed of at least two layers consisting of the surface layer, having a high electric resistance, which is made of the rubber composition and the base layer, having a low electric resistance, which is made of the electroconductive rubber composition. The semi-conductive rubber member provides a preferable charging characteristic in a favorable balance between the electric resistance value of the surface layer and that of the base layer.

It is difficult and necessary to make the thickness of both layers highly accurate. To achieve a high thickness accuracy for both layers, troublesome management is required, and the cost for producing the semi-conductive rubber member is high because the yield is low even though the troublesome management is made. Thus there is room for improvement in producing the semi-conductive rubber member at a low cost by a simple process management.

The present applicant also proposed a semi-conductive rubber member, as described in Japanese Patent Application Laid-Open No. 2006-99036 (patent document 2). The semi-conductive rubber member has the chloroprene rubber-containing conductive rubber layer composing the outermost layer and having a dielectric loss tangent of 0.1 to 1.8. The semi-conductive rubber member is capable of imparting a very high electric charge to toner or the like which sticks thereto and preventing the leak of an electric charge imparted to the toner.

In the semi-conductive rubber member, the dielectric loss tangent is adjusted to the above-described range by using the weakly conductive carbon black capable of imparting dielectric property thereto irrespective of the kind of the rubber component and without adversely affecting the electric resistance value thereof. Thereby the initial image density and durability (stability of charged amount of tone with age) are improved at a very high level. But there is room for improvement in achieving the initial image density and durability at the same time.

The present applicant also proposed a conductive rubber roller, as described in Japanese Patent Application Laid-Open No. 2004-170845 (patent document 3). The conductive roller is composed of the ionic-conductive rubber, having a uniform electrical characteristic, which contains the dielectric loss tangent-adjusting filler for adjusting the dielectric loss tangent thereof to 0.1 to 1.5. The conductive rubber roller is capable of imparting a proper and high charging property to toner, thereby providing a high-quality initial image. In the conductive rubber roller, the charged amount of the toner little decreases even after printing of a considerable number of sheets finishes. Consequently the conductive rubber roller keeps providing a high-quality image for a long time.

As disclosed in the patent document 3, the rubber component represented by epichlorohydrin rubber which contains chlorine atoms is used for the conductive rubber roller to allow the conductive rubber roller to be ionic-conductive. In this case, the rubber component containing the chlorine atoms has a high surface free energy. Thus toner as well as an additive for the toner are liable to adhere to the rubber component containing the chlorine atoms.

When ionic-conductive ethylene oxide monomer is polymerized, the conductive roller has a high surface free energy and is liable to get wet. Thereby the adhesion of the toner to the conductive rubber roller becomes high.

When an oxide film is formed on the surface of the conductive rubber roller by irradiating the surface thereof with ultraviolet rays or exposing it to ozone, the oxygen concentration of the surface of the conductive rubber roller becomes high. Thus the surface free energy increases. Thereby the adhesion of the toner to the conductive rubber roller further increases.

When the dielectric loss tangent of the conductive rubber roller is set to 0.1 to 1.5, it is possible to improve the charging property of the toner and hence decrease the toner transport amount. Thus the conductive rubber roller provides a high-quality image such as a half-tone image. On the other hand, the amount of the toner deposited on a developing roller decreases. Thereby when the conductive rubber roller is used as the developing roller, the adhesion of the toner to the developing rubber roller further increases.

The toner which has adhered to the conductive rubber roller does not considerably affect images formed in an early stage and images successively printed. But when images are printed in the following conditions (1) through (4), the influence of the toner that has adhered to the conductive rubber roller cannot be ignored. For example, normally, charged toner is transported to a photosensitive drum having an opposite electric charge by an electrostatic force (Coulomb force). But the transport of the toner by the electrostatic force is prevented because the adhesion of the toner to the developing roller is high. Thus there arises a problem that the print density becomes low, although the amount of charging applied to the toner does not change.

(1) When printing is made on a considerable number of sheets of paper and hence toner has affinity for the developing roller (for example, when image is printed at 1% on about 2,000 sheets of paper).

(2) When an average particle diameter of toner is not more than 8 μm and particularly not more than 6 μm.

(3) When printing is made not successively, but is suspended and made the next day.

(4) When the developing roller is used in a low-temperature and low-humidity environment in which the charged amount of toner is comparatively large.

Disclosed in Japanese Patent Application Laid-Open No. 2005-225969 (patent document 4) is the semi-conductive rubber member composed of the ionic-conductive rubber component containing the rubber having the polyether bond. Wax is added to the rubber component of the ionic-conductive rubber to decrease the free energy of the surface thereof so that the additive for toner can be prevented from adhering to the surface thereof for a long time. Further the semi-conductive rubber member is excellent in its processability and is capable of preventing the surface thereof from having defects such as molding nonuniformity and crack.

But when the semi-conductive rubber member is used as the developing roller, the adhesion of toner is still high, which may cause "decrease in print density". In addition, there is a case in which the toner and a photosensitive drum are contaminated to a slight degree owing to the presence of a component having a low-molecular weight that leads to bleed of wax or the like and owing to the adhesion in environment having a comparatively high temperature of about 50° C. Therefore when the semi-conductive rubber member is used for a printer or the like demanded to provide a high-quality image, the kind of rubber or polymer which can be used for the semi-conductive rubber member is limited. Thus there is room for improvement in the semi-conductive rubber member.

When the above-described conductive roller is used as the developing roller, even though the charged toner has a state in which it is transported to a photosensitive drum having an opposite electric charge by an electrostatic force (Coulomb force), the transport of the toner by the electrostatic force is prevented because the physical adhesion of the toner to the developing roller is high. Thus although there is no change in the charged amount applied to the toner, print density drops, i.e., a problem of "drop of developing efficiency" occurs. As described above, the tendency that the developing efficiency drops although there is a large amount of the toner which can be transported is conspicuous in a high-speed printer having a speed of not less than 20 rpm.

As a result of the drop of the developing efficiency, a large amount of toner circulates in a toner box, which causes the toner to deteriorate. Consequently a decrease in the charged amount of the toner is accelerated. As a result, there occurs a problem that defective images are formed at an early stage of use. That is, when the developing roller transports a large amount of toner mainly because electrostatic and physical separation of the toner from the developing roller is unfavorable, most of toner transported by the developing roller does not contribute to printing to be made by the photosensitive drum, but remains in the developing roller and returns to the toner box. As a result, while the toner is repeatedly circulating within the toner box, the toner rubs each other and is damaged. In this way, the deterioration of the toner is accelerated to generate defective images at a later stage of an endurance use.

To solve the above-described problem, the present applicant proposed a semi-conductive rubber roller, as described in Japanese Patent Application Laid-Open No. 2007-72445 (patent document 5). The resin or the rubber of the semi-conductive roller essentially contains the resin or the rubber containing chlorine atoms and further contains 3 to 60 parts by mass of the titanium oxide for 100 parts by mass of the resin or the rubber.

In the semi-conductive roller, even in the case where the rubber component containing the chlorine atoms having a high surface free energy is used, it is possible to decrease the adhesion of the toner by adding a necessary amount of the titanium oxide to the resin or the rubber containing the chlorine atoms. In the concrete form of the patent document 5, the resin or the rubber containing chlorine atoms contains the agent such as weakly conductive carbon black for adjusting the dielectric loss tangent in addition to the titanium oxide so that the dielectric loss tangent in a predetermined condition is 0.1 to 1.8. In this manner, it is possible to apply a high charged amount to the toner and obtain a sufficient print density.

But in the form of the patent document 5, there is a case where the adhesion of the toner is so electrostatically high that the developing efficiency drops and the deterioration of the toner is accelerated. Consequently there is a fear that a defective image is generated at a later stage of an endurance use. Thus the semi-conductive roller of the patent document 5 has room for improvement in this respect.

Patent document 1: Japanese Patent Application Laid-Open No. 2007-286236

Japanese Patent document 2: Japanese Patent Application Laid-Open No. 2006-99036

Japanese Patent document 3: Japanese Patent Application Laid-Open No. 2004-170845

Japanese Patent document 4: Japanese Patent Application Laid-Open No. 2005-225969

Japanese Patent Application Laid-Open No. 2007-72445

SUMMARY OF THE INVENTION

The present invention has been made in view of the above-described problems. It is an object of the present invention to provide a conductive roller which restrains the transport of excessive toner, allows a preferable toner separation to be accomplished, allows a proper print density to be kept, and provides an excellent printing performance for a long time from an initial stage of use.

To solve the above-described problems, the present invention provides a conductive roller having a toner transport part composed of a vulcanized rubber composition on an outermost layer thereof. The vulcanized rubber composition contains a rubber component (A), highly conductive carbon black (B) having a particle diameter not less than 18 nm and less than 80 nm, an inorganic filler (C) consisting of not less than one kind of a metal oxide selected from among a group of titanium oxide, alumina, and silica. A total of a content of the highly conductive carbon black (B) and a content of the inorganic filler (C) for 100 parts by mass of the rubber component (A) is not less than 10 parts by mass nor more than 60 parts by mass.

When only the highly conductive carbon black (B) is added to the rubber component (A) as the filler, it is possible to obtain a high initial print density by adding not less than 10 parts by mass of the highly conductive carbon black (B) for 100 parts by mass of the rubber component (A). Because the highly conductive carbon black (B) has a high conductivity, an electric charge does not collect on the conductive roller in a continuous use of the conductive roller. Thus it is possible to use the conductive roller in a stable state. But because the electric charge does not collect on the conductive roller, there occurs a problem that charged toner cannot be electrically controlled. Therefore only the adhesion of the toner acts on the surface of the conductive roller, which leads to an increase of a toner transport amount, the deterioration of the durability of the conductive roller, and a drop of print density.

When only the inorganic filler (C) consisting of the metal oxide is added to the rubber component (A), it is possible to obtain the effect of decreasing the physical adhesion of the toner, but impossible to impart a sufficient charging property to the toner. Consequently a sufficient print density cannot be obtained.

To solve the above-described problem, the present inventors have made energetic investigations and found that by setting the total of the content of the highly conductive carbon black (B) and the content of the inorganic filler (C) for 100 parts by mass of the rubber component (A) to not less than 10 parts by mass nor more than 60 parts by mass, the balance is excellently kept between the toner adhesion effect provided by the highly conductive carbon black (B) and the effect of decreasing the adhesion of the toner provided by the inorganic filler (C). That is, they have found that it is possible to produce a conductive roller having conflicting performances, difficult to be compatible with each other, which are "improvement of durability owing to a decrease of the adhesion of the toner, in other words, a decrease of a toner transport amount" and "achievement of a high print density".

The total of the content of the highly conductive carbon black (B) and the content of the inorganic filler (C) for 100 parts by mass of the rubber component (A) is set to not less than 10 nor more than 60 parts by mass for the reason described below. When the total of the content of the highly conductive carbon black (B) and that of the inorganic filler (C) is less than 10 parts by mass, it is impossible to obtain the effect provided by mixing the highly conductive carbon black (B) and the inorganic filler (C) with the rubber component (A). On the other hand, when the total of the content of the highly conductive carbon black (B) and that of the inorganic filler (C) is more than 60 parts by mass, the conductive roller is so hard that the durability thereof is outstandingly inferior and a nip becomes unstable when the conductive roller contacts other members, for example, a photosensitive drum. Consequently an obtained image is defective.

It is preferable that the vulcanized rubber composition composing the toner transport part contains not less than one part by mass nor more than 40 parts by mass of the highly conductive carbon black (B) and not less than one part by mass nor more than 40 parts by mass of the inorganic filler (C) for 100 parts by mass of the rubber component (A).

By setting the mixing ratio of the highly conductive carbon black (B) and the inorganic filler (C) to the rubber component (A) to the above-described range, it is possible to prevent an increase of the hardness of the conductive roller and expect the synergy of the highly conductive carbon black (B) and the inorganic filler (C). That is, the present inventors have completed the conductive roller having an excellent toner transport characteristic, not affected owing to a drop of an electrical control caused by a low electric resistance, which is provided by stabilizing the performance of the conductive roller without collecting an electric charge on the conductive roller because the conductive roller has a low electric resistance and by decreasing the physical adhesion of the toner to the surface of the conductive roller.

The vulcanized rubber composition contains not less than five parts by mass nor more than 30 parts by mass of the highly conductive carbon black (B) and not less than 10 parts by mass nor more than 40 parts by mass of the inorganic filler (C) for 100 parts by mass of the rubber component (A). The total of the content of the highly conductive carbon black (B) and the content of the inorganic filler (C) for 100 parts by mass of the rubber component (A) is not less than 10 parts by mass nor more than 40 parts by mass.

The above-described mixing ratio provides stable performance in "toner transport amount", "durability", and "print density".

The rubber component (A) to be contained in the vulcanized rubber composition is not limited to a specific one, but known rubber may be used. But it is preferable to use vulcanized rubber satisfying at least one of requirements (1) through (4) described below.

(1) Rubber containing chlorine atoms (2) Rubber having an SP value not less than 18.0 $(MPa)^{1/2}$ (3) Ionic-conductive rubber (4) Ionic-conductive rubber containing an ionic-conductive material By using the above-described rubber components, the conductive roller of the present invention shows a preferable characteristic when it is used as a developing roller to be mounted on a developing device, using unmagnetic one-component toner, which is used for an image-forming mechanism of an electrophotographic apparatus.

In the present invention, carbon black having a small diameter not less than 18 nm and less than 80 nm is defined as "highly conductive carbon black". Carbon black having a large diameter not less than 80 nm and less than 500 nm is defined as "weakly conductive carbon black" clearly distinguished from the highly conductive carbon black in the particle diameter. The "particle diameter" described in the present specification indicates "average primary particle diameter".

There is a conspicuous difference between the conductivity of the carbon black having a particle diameter not less than 80 nm and the carbon black having a particle diameter less than 80 nm. The highly conductive carbon black and the weakly conductive carbon black have a different role when they are contained in the vulcanized rubber composition. That is, the weakly conductive carbon black has a large particle diameter and its structure has developed to a low extent, thus contributing to conductivity to a low extent. By containing the weakly conductive carbon black in the conductive roller, it is possible to obtain a capacitor-like operation owing to a polarization effect without increasing the conductivity and control the charging property without damaging uniformity of the electric resistance. On the other hand, the highly conductive carbon black has a smaller particle diameter than the weakly conductive carbon black and its structure has developed to a high extent, thus contributing to the conductivity to a high extent. Therefore by containing the highly conductive carbon black in the conductive roller, it is possible to enhance the conductivity. In using the conductive roller as a developing roller, it is possible to obtain a high print density even though the developing roller contacts a photosensitive drum in a short period of time because the printer is operated at a high speed and even though the developing roller contacts the photosensitive drum in a small area because the printer is compact and hence the diameter of the photosensitive drum is small.

When only the "weakly conductive carbon black" having a particle diameter not less than 80 nm and less than 500 nm is used, it is possible to charge the toner to a high extent and obtain a sufficient print density. But the balance between the toner adhesion decreasing effect to be provided by the inorganic filler (C) and the electrostatic toner adhesion increasing effect to be provided by the weakly conductive carbon black are kept insufficiently. There is a case where the electrostatic toner adhesion becomes so high that the developing efficiency deteriorates, and the deterioration of the toner is accelerated. Consequently there is a fear that a defective image is generated at a later stage of an endurance use.

On the other hand, when the carbon black whose particle diameter is less than 18 nm is used, it cannot be uniformly dispersed in the vulcanized rubber composition. Thus the toner transport amount is nonuniform at portions where the carbon black is non-uniformly dispersed. Thereby there is a fear that a defective image is generated and that the toner-sealing part of the conductive roller is broken, which causes the toner to leak.

It is favorable to use the highly conductive carbon black (B) having an iodine adsorption amount of 50 to 200 mg/g, a specific surface area of 30 to 140 $m^2/g$, and a DBP oil absorption amount of 20 to 150 ml/100 g.

As the inorganic filler (C) contained in the vulcanized rubber composition, the titanium oxide, the alumina or the silica is used. It is possible to singly use one kind of the inorganic filler (C) singly or not less than two kinds thereof in combination. It is favorable to use the titanium oxide. Because the titanium oxide is neutral in its charging property, the titanium oxide is not affected by the kind and composition of the rubber component, the property (dielectric loss tangent) of the conductive roller, and the like irrespective of the polarity of the toner and is capable of stably displaying the effect of decreasing the adhesion of the toner.

The conductive roller of the present invention has the toner transport part made of the vulcanized rubber composition described above at least on the outermost layer thereof. The toner transport part may be composed of one layer, made of the vulcanized rubber composition, constructing the outermost layer thereof or two or more layers made of different compositions.

It is preferable to compose the conductive roller of only one layer made of the vulcanized rubber composition, because the conductive roller can be produced in a simple method and is thus preferable from the standpoint of production efficiency. In this case, a cylindrical core is inserted into a hollow portion of the toner transport part made of the vulcanized rubber composition by press fit.

In using the conductive roller of the present invention as the toner transport part of the developing roller or the like, it is preferable to provide the conductive roller with a sealing member for preventing the leak of the toner. In addition to the sealing member for preventing the leak of the toner, the sealing member includes members that slidingly contact the peripheral surface of the conductive roller.

It is preferable to form an oxide film on the surface of the toner transport part by irradiating the surface thereof with ultraviolet rays.

Because the oxide film can be promptly formed by irradiating the surface of the toner transport part with the ultraviolet rays at a low cost, it is preferable to perform an oxide film forming operation. By forming the oxide film, the oxide film serves as a dielectric layer. Thereby it is possible to decrease the dielectric loss tangent. Consequently it is possible to efficiently apply the charging property to the toner and maintain the charging property applied thereto. In addition the oxide film may be formed by a known method of exposing the surface of the toner transport part to ozone or by other known methods.

It is preferable to use the conductive roller of the present invention as a developing roller for use in image-forming mechanisms of electrophotographic apparatuses of office automation appliances such as a laser beam printer, an ink jet printer, a copying machine, a facsimile, an ATM, and the like.

It is especially preferable to use the conductive roller for the toner transport part of a developing roller, a toner supply roller, a cleaning roller, a charging roller, a transfer roller, and the like for transporting unmagnetic one-component toner and members that contact the toner. In this case, because at least the outermost layer of the toner transport part is made of the vulcanized rubber composition, it is possible to easily obtain the uniformity of the electrical property and repeated reproducibility of design values at a low cost.

The conductive roller of the present invention is preferably used as the developing roller to be mounted on a developing device, using the unmagnetic one-component toner, which is mounted on the image-forming mechanism of the electrophotographic apparatus. The developing method carried out in the image-forming mechanism of the electrophotographic apparatus is classified into a contact type and a non-contact type in terms of the relation between the photosensitive drum and the developing roller. The conductive roller of the present invention can be utilized for both types. It is preferable that the conductive roller of the present invention is in contact with the photosensitive drum when the conductive roller is used as the developing roller.

The effect of the present invention is described below. By combining the highly conductive carbon black (B) and the inorganic filler (C) with each other and mixing them at the predetermined ratio, the balance is excellently kept between the toner adhesion effect provided by the highly conductive carbon black (B) and the effect of decreasing the adhesion of the toner provided by the inorganic filler (C). Thereby the conductive roller restrains an excessive amount of toner from being transported and is capable of accomplishing a preferable toner separation. Thus the conductive roller allows a proper degree of print density to be maintained and an excellent printing performance to be displayed for a long time from an initial stage.

The conductive roller of the present invention can be produced at a low cost in a simple process management without decreasing the yield of a product. In addition a high thickness accuracy is not demanded and a particular equipment is not required.

DETAILED DESCRIPTION OF THE PREFERRED EMBODIMENTS

An embodiment of the present invention is described below with reference to the drawing.

A conductive roller 10 of the embodiment of the present invention is a developing roller used for a developing device, using the unmagnetic one-component toner, which is used in an image-forming mechanism of an electrophotographic apparatus.

As shown in FIG. 1, the conductive roller has a toner transport part 1 constructed of a vulcanized rubber composition, a columnar core (shaft) 2 inserted into a hollow portion of the toner transport part 1 by press fit, and a sealing part 3 for preventing leak of the toner.

The toner transport part 1 has a thickness of 0.5 mm to 15 mm and favorably 3 to 15 mm. The reason the thickness of the toner transport part 1 is set to 0.5 mm to 15 mm is as follows: If the thickness thereof is less than 0.5 mm, it is difficult to obtain an appropriate nip. If the thickness of the toner transport part 1 is more than 15 mm, the toner transport part 1 is so large that it is difficult to produce a small and lightweight developing roller 10.

The core 2 is made of metal such as aluminum, aluminum alloy, SUS or iron or ceramics. The toner transport part 1 and the core 2 are bonded to each other with a conductive adhesive agent.

The sealing part 3 is made of nonwoven cloth such as Teflon (registered trade mark) or a sheet.

The vulcanized rubber composition composing the toner transport part 1 contains the rubber component (A), the highly conductive carbon black (B), the inorganic filler (C) consisting of not less than one kind of the metal oxide selected from among the group of the titanium oxide, the alumina, and the silica. The total of the content of the highly conductive carbon black (B) and the content of the inorganic filler (C) for 100 parts by mass of the rubber component (A) is not less than 10 parts by mass nor more than 60 parts by mass and favorably not less than 10 parts by mass nor more than 40 parts by mass. The content ratio of each of the highly conductive carbon black (B) and that of the inorganic filler (C) is not limited to a specific content ratio, but it is preferable that the content of the highly conductive carbon black (B) is larger than that of the inorganic filler (C).

It is favorable that the content of the highly conductive carbon black (B) for 100 parts by mass of the rubber component (A) is not less than one part by mass nor more than 40 parts by mass. When the content of the highly conductive carbon black (B) is less than one part by mass, a sufficient conductivity cannot be obtained. Thus it is impossible to obtain a high print density. On the other hand, when the content of the highly conductive carbon black (B) is more than 40 parts by mass, the conductivity is so high that a sufficient chargeability cannot be obtained and in addition there is a fear that the deterioration of the toner occurs owing to a rise of the hardness of the conductive roller.

The content of the highly conductive carbon black (B) for 100 parts by mass of the rubber component (A) is more favorably not less than five parts by mass, more favorably not less than 10 parts by mass, and most favorably not less than 15 parts by mass. The content of the highly conductive carbon black (B) for 100 parts by mass of the rubber component (A) is favorably not more than 30 parts by mass and most favorably not more than 25 parts by mass.

It is preferable that the vulcanized rubber composition contains not less than one part by mass nor more than 40 parts by mass of the inorganic filler (C) for 100 parts by mass of the rubber component (A). When the content of the inorganic filler (C) is less than one part by mass, it is impossible to decrease the physical adhesion of the toner. That is, it is impossible to improve the toner separation. On the other hand, when the content of the inorganic filler (C) is more than 40 parts by mass for 100 parts by mass of the rubber component (A), the hardness of the toner transport part 1 is so high that the deterioration of the toner is accelerated, the toner cannot be appropriately charged, and that the durability of an abrasive material for abrading the surface of the toner transport part 1 has a low durability, which necessitates re-dressing. Further the inorganic filler (C) is mixed with the highly conductive carbon black (B) to a low extent.

The content of the inorganic filler (C) for 100 parts by mass of the rubber component (A) is favorably not less than two parts by mass, more favorably not less than 2.5 parts by mass, and most favorably not less than five parts by mass. The content of the inorganic filler (C) for 100 parts by mass of the rubber component (A) is favorably not more than 30 parts by mass, more favorably not more than 25 parts by mass, and most favorably not more than 20 parts by mass.

Components contained in the vulcanized rubber composition are described in detail below.

The rubber component (A) is not limited to a specific rubber component, but it is preferable to use vulcanized rubber satisfying at least one of the requirements (1) through (4) described below.

(1) Rubber containing chlorine atoms (2) Rubber having an SP value not less than 18.0 $(MPa)^{1/2}$ (3) Ionic-conductive rubber (4) Ionic-conductive rubber containing an ionic-conductive material (1) As "the rubber having chlorine atoms", known rubber can be used, provided that it has chlorine atoms. More specifically, unconductive rubber such as chloroprene rubber, chlorinated butyl, chlorosulfonated polyethylene, and the like little showing conductivity; and conductive rubber such as an epichlorohydrin copolymer are listed.

The rubber having the chlorine atoms has a characteristic that it is capable of very easily charging toner positively charged, but the rubber having the chlorine atoms has a larger adhesion than rubber not having the chlorine atoms. Therefore when the rubber component (A) contains "the rubber having the chlorine atoms", by using the present invention, it is possible to effectively restrain a high non-electrostatic adhesion and an electrostatic adhesion of "the rubber having the chlorine atoms" which are disadvantage thereof.

When the unconductive rubber is used as the rubber having the chlorine atoms, it is preferable to combine the unconductive rubber with the ionic-conductive rubber to make the outermost layer of the toner transport part ionic-conductive. As the ionic-conductive rubber which can be used in the present invention, a polyether copolymer and the epichlorohydrin copolymer are listed. Even when the ionic-conductive rubber is used as the rubber having the chlorine atoms, the ionic-conductive rubber may be combined with the ionic-conductive rubber not having the chlorine atoms.

(2) As "the rubber having the SP value not less than 18.0 $(MPa)^{1/2}$", it is possible to list the epichlorohydrin copolymer, the polyether copolymer, acrylic rubber, NBR having the amount of acrylonitrile not less than 20%, and chloroprene rubber.

The SP value means a solubility parameter or a solubility constant. As is defined in a book "Flow of paint and dispersion of pigment" (compiled by Kenji Ueki and published by Kyoritsu Publishing Co., Ltd.), the SP value is the square root of a cohesive energy density of each liquid and serves as an index characterizing the solubility. The higher the SP value is, the higher the polarity is. In blending two or more kinds of rubbers with each other, rubber having the SP value less than 18.0 $(MPa)^{1/2}$ may be used, but the mixing amount thereof is so adjusted that an apparent SP value thereof is not less than 18.0 $(MPa)^{1/2}$. The apparent SP value is obtained by computing the product of an SP value inherent in each rubber component and a mass mixing ratio of each rubber component when the entire rubber component is supposed to be 1 and by finding the sum of the products. For example, supposing that the SP value of a component a is Xa, that the mass mixing ratio thereof is Ya when the entire rubber component is supposed to be 1, that the SP value of a component b is Xb, and that the mass mixing ratio thereof is Yb when the entire rubber component is supposed to be 1, the apparent SP value is Xa·Ya+Xb·Yb.

By selecting the kind of rubber, "the rubber having the SP value not less than 18.0 $(MPa)^{1/2}$" has a possibility of imparting a very high chargeability to the toner positively charged and the toner negatively charged, but has a very high polarity and hence a high adhesion. Experiments have revealed that owing to the high polarity of "the rubber having the SP value not less than 18.0 $(MPa)^{1/2}$" and shearing effect of the filler, "the rubber having the SP value not less than 18.0 $(MPa)^{1/2}$" is very dispersive even though a plurality of fillers is mixed therewith. Therefore when the vulcanized rubber composition contains "the rubber having the SP value not less than 18.0 $(MPa)^{1/2}$", by simultaneously adding the highly conductive carbon black (B) and the inorganic filler (C) to the "the rubber having the SP value not less than 18.0 $(MPa)^{1/2}$", it is possible to effectively suppress the high adhesion of "the rubber having the SP value not less than 18.0 $(MPa)^{1/2}$" without inhibiting the advantage of the rubber having a high polarity.

"The rubber having the SP value not less than 18.0 $(MPa)^{1/2}$" may be the unconductive rubber little showing conductivity or the ionic-conductive rubber.

Because the vulcanized rubber composition of the present invention contains the highly conductive carbon black (B) as its essential component, the vulcanized rubber composition is conductive even though "the rubber having the SP value not less than 18.0 $(MPa)^{1/2}$" consists of the unconductive rubber. "The rubber having the SP value not less than 18.0 $(MPa)^{1/2}$" may be combined with the ionic-conductive rubber. Alternatively electroconductive materials other than the highly conductive carbon black (B) or an ionic-conductive material may be added to "the rubber having the SP value not less than 18.0 $(MPa)^{1/2}$" to impart conductivity thereto.

As the other electroconductive materials, it is possible to list conductive metal oxides such as zinc oxide, potassium titanate, antimony-doped titanium oxide, tin oxide, and graphite; and carbon fibers. The mixing amount of the other electroconductive materials can be appropriately selected in consideration of the properties such as the electric resistance value of the conductive roller. The mixing amount of the other electroconductive materials for 100 parts by mass of the rubber component is set to favorably 5 to 40 parts by mass and more favorably 10 to 25 parts by mass. It is preferable that the particle diameters of the other electroconductive materials are less than 80 nm.

(3) As "the ionic-conductive rubber", copolymers such as the polyether copolymer and the epichlorohydrin copolymer containing the ethylene oxide therein are listed.

"The ionic-conductive rubber" is capable of easily maintaining the uniformity of its electric characteristic and repeated reproducibility of design values, but has affinity for water and has a high surface free energy and is liable to get wet. Therefore the ionic-conductive rubber has a high degree of adhesion. Thus when the rubber component (A) contains "the ionic-conductive rubber", by using the present invention, it is possible to effectively suppress the high adhesion thereof which is a disadvantage of "the ionic-conductive rubber".

(4) It is possible to select various ionic-conductive materials of the "ionic-conductive rubber containing the ionic-conductive material". It is possible to use quaternary ammonium salts, metal salts of carboxylic acid, carboxylic acid derivatives such as carboxylic acid anhydride, esters; condensates of aromatic compounds, organometallic complexes, metal salts, chelate compounds, monoazo metal complexes, acetylacetone metal complexes, hydroxycarboxylic acid metal complexes, polycarboxylic metal complexes, polyol metal complexes. These ionic-conductive materials are used as an antistatic agent or a charge control agent.

As the ionic-conductive agents, it is possible to list anion-containing salts having a fluoro group and a sulfonyl group as preferable examples. More specifically, it is possible to list salts of bisfluoroalkylsulfonylimide, salts of tris(fluoroalkylsulfonyl)methane, and salts of fluoroalkylsulfonic acid. As cations of the above-described salts making a pair with the anions, metal ions of the alkali metals, the group 2A metals, and other metal ions are favorable. A lithium ion is more favorable. As the ionic-conductive materials, it is possible to list $LiCF_3SO_3$, $LiC_4F_9SO_3$, $LiN(SO_2CF_3)_2$, $LiC(SO_2CF_3)_3$, and $LiCH(SO_2CF_3)_2$.

The mixing amount of the ionic-conductive material can be appropriately selected according to the kind thereof. For example, the mixing amount thereof for 100 parts by mass of the rubber component is set to favorably 0.1 to five parts by mass.

As more favorable forms of the rubber component (A), the following combinations (a) through (c) are listed.

(a) One epichlorohydrin copolymer (b) Combination of the chloroprene rubber, the epichlorohydrin copolymer or/and the polyether copolymer (c) Combination of the chloroprene rubber and the NBR Above all, the combination (b-1) of the chloroprene rubber and the epichlorohydrin copolymer, the combination (b-2) of the chloroprene rubber, the epichlorohydrin copolymer, and the polyether copolymer, and the combination (c) of the chloroprene rubber and the NBR are more favorable. The combination (b-1) of chloroprene rubber and the epichlorohydrin copolymer and the combination (c) of the chloroprene rubber and the NBR are especially favorable.

In combining not less than two kinds of the rubber as the rubber component (A), the mixing ratio is appropriately selected.

For example, in the combination (b-1) of the chloroprene rubber and the epichlorohydrin copolymer, the content of the epichlorohydrin copolymer for 100 parts by mass of the rubber component is set to 5 to 95 parts by mass, favorably 20 to 80 parts by mass, and more favorably 20 to 50 parts by mass. The content of the chloroprene rubber for 100 parts by mass of the rubber component is set to 5 to 95 parts by mass, favorably 20 to 80 parts by mass, and more favorably 50 to 80 parts by mass.

In the combination (b-2) of the chloroprene rubber, the epichlorohydrin copolymer, and the polyether copolymer, the content of the epichlorohydrin copolymer for 100 parts by mass of the rubber component is set to 5 to 90 parts by mass and favorably 10 to 70 parts by mass. The content of the polyether copolymer for 100 parts by mass of the rubber component is set to 5 to 40 parts by mass and favorably 5 to 20 parts by mass. The content of the chloroprene rubber for 100 parts by mass of the rubber component is set to 5 to 90 parts by mass and favorably 10 to 80 parts by mass. By setting the mixing ratio among the three components to the above-described range, it is possible to favorably disperse the three components and improve the properties of the rubber component (A) such as the strength thereof. The mass ratio among the epichlorohydrin copolymer, the chloroprene rubber, and the polyether copolymer is set to favorably 2 to 5:4 to 7:0.5 to 1.5 and more favorably 2 to 5:4 to 7:1.

In the combination (c) of the chloroprene rubber and the NBR, the content of the NBR for 100 parts by mass of the rubber component is set to 5 to 95 parts by mass, favorably 20 to 80 parts by mass, and more favorably 20 to 50 parts by mass. The content of the chloroprene rubber for 100 parts by mass of the rubber component is set to 5 to 95 parts by mass, favorably 20 to 80 parts by mass, and more favorably 50 to 80 parts by mass.

As the epichlorohydrin copolymers, it is possible to list epichlorohydrin homopolymer, an epichlorohydrin-ethylene oxide copolymer, an epichlorohydrin-propylene oxide copolymer, an epichlorohydrin-allyl glycidyl ether copolymer, an epichlorohydrin-ethylene oxide-allyl glycidyl ether copolymer, an epichlorohydrin-propylene oxide-allyl glycidyl ether copolymer, and an epichlorohydrin-ethylene oxide-propylene oxide-allyl glycidyl ether copolymer.

It is preferable that the epichlorohydrin copolymer contain the ethylene oxide. The epichlorohydrin copolymer contains the ethylene oxide at not less than 30 mol % nor more than 95 mol %, favorably not less than 55 mol % nor more than 95 mol %, and more favorably not less than 60 mol % nor more than 80 mol %. The ethylene oxide has a function of decreasing the volume resistivity, but when the content of the ethylene oxide is less than 30 mol %, the ethylene oxide has a low effect of decreasing the volume resistivity. When the content of the ethylene oxide is more than 95 mol %, the ethylene oxide crystallizes and the segment motion of the molecular chain thereof is prevented from taking place. Consequently the volume resistivity tends to rise and in addition the hardness of the vulcanized rubber and the viscosity of the rubber before vulcanization are liable to rise.

As the epichlorohydrin copolymer, it is especially preferable to use an epichlorohydrin (EP)-ethylene oxide (EO)-allyl glycidyl ether (AGE) copolymer. As the content ratio among the EO, the EP, and the AGE in the epichlorohydrin copolymer, EO:EP:AGE is set to favorably 30 to 95 mol %:4.5 to 65 mol %:0.5 to 10 mol % and more favorably 60 to 80 mol %:15 to 40 mol %:2 to 6 mol %.

As the epichlorohydrin copolymer, it is also possible to use an epichlorohydrin (EP)-ethylene oxide (EO) copolymer. As the content ratio between the EO and the EP, EO:EP is set to favorably 30 to 80 mol %:20 to 70 mol % and more favorably 50 to 80 mol %:20 to 50 mol %.

The mixing amount of the epichlorohydrin copolymer for 100 parts by mass of the rubber component is favorably not less than five parts by mass, more favorably not less than 15 parts by mass, and most favorably not less than 20 parts by mass.

As the polyether copolymer, it is possible to list an ethylene oxide-propylene oxide-allyl glycidyl ether copolymer, an ethylene oxide-allyl glycidyl ether copolymer, a propylene oxide-allyl glycidyl ether copolymer, an ethylene oxide-propylene oxide copolymer, and urethane rubber.

It is favorable that the polyether copolymer contains the ethylene oxide. It is more favorable that the polyether copolymer contains 50 to 95 mol % of the ethylene oxide. As the mixing ratio of the ethylene oxide increases, it is possible to increasingly stabilize ions and decrease the electric resistance of the conductive roller. But when the mixing ratio of the ethylene oxide is very high, the ethylene oxide crystallizes and the segment motion of the molecular chain thereof is prevented from taking place. Consequently there is a possibility that the electric resistance value of the conductive roller rises.

It is preferable that the polyether copolymer contains the allyl glycidyl ether in addition to the ethylene oxide. By copolymerizing the allyl glycidyl ether, the allyl glycidyl ether unit obtains a free volume as a side chain. Thus the crystallization of the ethylene oxide is suppressed. As a result, the conductive roller has a lower electric resistance than conventional conductive rollers. By copolymerizing the allyl glycidyl ether, carbon-to-carbon double bonds are introduced into the polyether copolymer. Thus it is possible to crosslink it with other kind of rubber and thereby prevent occurrence of bleeding and other members such as a photosensitive drum from being contaminated.

It is preferable that the polyether copolymer contains 1 to 10 mol % of the allyl glycidyl ether. When the polyether copolymer contains less than one mol % of the allyl glycidyl ether, bleeding and contamination of the other members are easy to occur. On the other hand, when the polyether copolymer contains more than 10 mol % of the allyl glycidyl ether, it is impossible to obtain the crystallization suppression effect to a higher extent than the extent of the crystallization suppression effect when the polyether copolymer contains 1 to 10 mol % of the allyl glycidyl ether, and the number of crosslinked points increases after vulcanization. Thus the conductive roller is incapable of having a low electric resistance value. In addition, the tensile strength, fatigue characteristic, and flexing resistance of the conductive roller deteriorate.

As the polyether copolymer to be used in the present invention, it is preferable to use an ethylene oxide (EO)-propylene oxide (PO)-allyl glycidyl ether (AGE) terpolymer. By copolymerizing the propylene oxide, it is possible to suppress the crystallization of the ethylene oxide to a higher extent. A preferable content ratio among the ethylene oxide (EO), the propylene oxide (PO), and the allyl glycidyl ether (AGE) of the polyether copolymer is EO:PO:AGE=50 to 95 mol %:1 to 49 mol %:1 to 10 mol %. To effectively prevent bleeding from occurring and the other members from being contaminated, it is preferable that the number-average molecular weight Mn of the ethylene oxide (EO)-propylene oxide (PO)-allyl glycidyl ether (AGE) terpolymer is not less than 10,000.

The mixing amount of the polyether copolymer for the total mass, namely, 100 parts by mass of the rubber component is favorably not less than five parts by mass and more favorably not less than 10 parts by mass.

The chloroprene rubber is a polymer of chloroprene and produced by emulsion polymerization thereof. In dependence on the kind of a molecular weight modifier, the chloroprene rubber is classified into a sulfur-modified type and a non-sulfur-modified type.

The chloroprene rubber of the sulfur-modified type is formed by plasticizing a polymer resulting from polymerization of sulfur and the chloroprene with thiuram disulfide or the like to adjust the resulting chloroprene rubber of the sulfur-modified type to a predetermined Mooney viscosity. The chloroprene rubber of the non-sulfur-modified type includes a mercaptan-modified type and a xanthogen-modified type. Alkyl mercaptans such as n-dodecyl mercaptan, tert-dodecyl mercaptan or octyl mercaptan is used as a molecular weight modifier for the mercaptan-modified type. An alkyl xanthogen compound is used as a molecular weight modifier for the xanthogen-modified type.

In dependence on a crystallization speed of generated chloroprene rubber, the chloroprene rubber is classified into an intermediate crystallization speed type, a low crystallization speed type, and a high crystallization speed type.

The chloroprene rubber of both the sulfur-modified type and the non-sulfur-modified type can be used in the present invention. But it is preferable to use the chloroprene rubber of the non-sulfur-modified type having the low crystallization speed.

When the chloroprene rubber is used, the mixing amount of the chloroprene rubber for the total mass, namely, 100 parts by mass of the rubber component is selected in the range of not less than 1 and less than 100 parts by mass. In view of the effect of imparting the charging property to the toner, the mixing amount of the chloroprene rubber is set to favorably not less than five parts by mass for 100 parts by mass of the rubber component. To make the rubber uniform, the mixing amount of the chloroprene rubber is set to favorably not less than 10 parts by mass for 100 parts by mass of the rubber component. The mixing amount of the chloroprene rubber is set to more favorably not more than 80 parts by mass and most favorably not more than 70 parts by mass for 100 parts by mass of the rubber component.

As the NBR, it is possible to use any of low-nitrile NBR containing the acrylonitrile at not more than 25%, intermediate-nitrile NBR containing the acrylonitrile in the range of 25 to 31%, moderate high-nitrile NBR containing the acrylonitrile in the range of 31 to 36%, and high-nitrile NBR containing the acrylonitrile not less than 36%.

In the present invention, to decrease the specific gravity of the rubber, it is preferable to use the low-nitrile NBR having a small specific gravity. To favorably mix the NBR with the chloroprene rubber, it is preferable to use the intermediate-nitrile NBR or the low-nitrile NBR. More specifically, from the standpoint of the SP value, the NBR containing the acrylonitrile is used at favorably in the range of 15 to 39%, more favorably in the range of 17 to 35%, and most favorably in the range of 20 to 30%.

It is effective to perform hydrogen addition or carboxylation on the NBR in dependence on the kind of toner to adjust the charging property to be applied to the toner.

When the NBR is used, the mixing amount of the NBR for the total mass, namely, 100 parts by mass of the rubber component is set to the range of 5 to 65 parts by mass, favorably in the range of 10 to 65 parts by mass, and more favorably in the range of 20 to 50 parts by mass. When the toner positively charged is used, the charged amount of the toner decreases. Thus the mixing amount of the NBR for 100 parts by mass of the rubber component is set to not more than 65 parts by mass. It is preferable that the content of the NBR for 100 parts by mass of the rubber component is set to not less than five parts by mass to substantially suppress an increase of the hardness of the rubber composition.

As the highly conductive carbon black (B), it is possible to use various kinds of carbon black in the above-described particle diameter range. It is possible to list conductive carbon black such as Ketchen black, furnace black, and acetylene black. In the classification of carbon and in the above-described particle diameter range, it is possible to list SAF carbon (average particle diameter: 18 to 22 nm), SAF-HS carbon (average particle diameter: about 20 nm), ISAF carbon (average particle diameter: 19 to 29 nm), N-339 carbon (average particle diameter: about 24 nm), ISAF-LS carbon (average particle diameter: 21 to 24 nm), I-ISAF-HS carbon (average particle diameter: 21 to 31 nm), HAF carbon (average particle diameter: about 26 to 30 nm), HAF-HS carbon (average particle diameter: 22 to 30 nm), N-351 carbon (average particle diameter: about 29 m), HAF-LS carbon (average particle diameter: about 25 to 29 nm), LI-HAF carbon (average particle diameter: about 29 nm), MAF carbon (average particle diameter: 30 to 35 nm), FEF carbon (average particle diameter: about 40 to 52 nm), SRF carbon (average particle diameter: 58 to 80 nm), SRF-LM carbon, and GPF carbon (average particle diameter: 49 to 80 nm) are listed. Above all, it is preferable to use the FEF carbon, the ISAF carbon, the SAF carbon, and the HAF carbon.

The vulcanized rubber composition may contain the weakly conductive carbon black whose particle diameter is not less than 80 nm and less than 500 nm. But it is preferable that the vulcanized rubber composition does not contain the weakly conductive carbon black to enhance the durability of the conductive roller. When the vulcanized rubber composition contains the weakly conductive carbon black, a large charged amount and a high print density are obtained at an early stage of use. But there is a case where the weakly conductive carbon black causes the toner to have very high electrostatic adhesion and thereby there is a fear that a defective image is generated at a later stage of the endurance use.

As the inorganic metal filler (C) consisting of the metal oxide, not less than one kind selected from among the group of the titanium oxide, the alumina, and the silica is used according to the property of the rubber component and the property of a roller. It is possible to use one kind of the inorganic filler (C) singly or desired two or three kinds thereof in combination. It is favorable to essentially use the titanium oxide because it is compatible with the highly conductive carbon black (B) in the dispersibility. It is more favorable to singly use the titanium oxide.

It is preferable that the inorganic filler (C) consisting of the titanium oxide, the alumina or the silica has a particle diameter smaller than that of the toner to be used. More specifically, the primary particle diameter of the inorganic filler (C) is favorably not more than 10 μm and more favorably not more than 5 μm in consideration of the action of the inorganic filler (C) on the toner. In consideration of the cost of the inorganic filler (C) and to preferably mix the inorganic filler (C) with other components, the diameter of the inorganic filler (C) is favorably not less than 1 nm and more favorably not less than 10 nm in consideration of the dispersibility thereof with the highly conductive carbon black (B). In consideration of the cost of the inorganic filler (C) and the performance thereof, the diameter thereof is favorably not less than 50 nm nor more than 1000 nm and more favorably not less than 100 nm nor more than 500 nm.

The type of the titanium oxide to be used in the present invention is not limited to a specific type, but a known type thereof can be used. As a crystalline type, it is possible to use any of an anatase type, a rutile type, a mixture of these two types, and an amorphous type. It is preferable to use the titanium oxide of the rutile type. The titanium oxide is obtained by a sulfuric acid method, a chlorine method; and low-temperature oxidation (thermal decomposition, hydrolysis) of a volatile titanium compound such as titanium alcoxide, titanium halide or titanium acetylacetonate, and the like.

It is favorable that the titanium oxide to be used in the present invention contains particles whose diameters are not more than 500 nm at not less than 50%. In this case, the titanium oxide has a high dispersibility. It is favorable to use the titanium oxide whose average particle diameter is 100 to 500 nm. It is especially favorable to use the titanium oxide of rutile type containing particles whose diameters are 300 to 500 nm in average as its main component.

The kind of the silica used in the present invention is not limited to a specific kind, but silica commercially available can be used. As the silica commercially available, "Nipseal VN3" produced by Tosoh Silica Corporation is exemplified. The silica may be surface-treated according to the property of the toner. As the surface treatment, hydrophobic treatment and hydrophilic treatment are exemplified.

It is especially preferable that the average primary particle diameter of the silica is 10 to 500 nm. The silica having a BET specific surface area of 30 to 300 $m^2/g$ is favorable. The silica having the BET specific surface area of 60 to 250 $m^2/g$ is more favorable.

The alumina is an oxide of aluminum ($Al_2O_3$). The alumina to be used in the present invention contains particles having the primary diameter of favorably not more than 1 μm at not less than 80% and more favorably at not more than 0.5

μm at not less than 50%. By using the alumina having a small particle diameter, it is possible to disperse it uniformly and thereby improve the heat dissipation effect described below and easily secure the uniformity of the surface of the toner transport part 1 of the conductive roller.

The alumina is excellent in the thermal conductivity thereof. Thus when the alumina is contained in the toner transport part 1, it is possible to rapidly disperse heat generated by friction between the sealing part 3 of the conductive roller and the peripheral surface of the toner transport part 1 thereof to the entire toner transport part 1. It is possible to dissipate heat transmitted to the inside of the toner transport part 1 to the outside via the core 2 made of a metal and in addition from the surface of the toner transport part 1. Therefore it is possible to restrain the wear of the sealing part 3 accelerated by the heat generated owing to the sliding friction between the sealing part 3 and the toner transport part 1. Thereby it is possible to prevent the leak of the toner for a long time.

In addition, the temperature of the toner transport part 1 is not risen by the heat generated in the sealing part 3 on which the toner transport part 1 slides. Therefore it is possible to prevent thermoplastic resin composing polymerized toner from being fused and toner particles from having a large diameter and the edges thereof from being sharpened and welded to each other. Thereby it is possible to prevent them from becoming large and angular. Therefore it is possible to much improve the durability of the sealing part 3 and that of the toner transport part 1.

In addition, by mixing the alumina and the titanium oxide simultaneously with the rubber component (A), the mixing efficiency of the titanium oxide increases. For example, the alumina and the titanium oxide are little detected as a foreign matter on the surface of the rubber.

Components other than the above-described essential components to be contained in the vulcanized rubber composition are described below.

The vulcanized rubber composition contains a vulcanizing agent for vulcanizing the rubber component.

As the vulcanizing agent, it is possible to use sulfur-based and thiourea-based vulcanizing agents, triazine derivatives, peroxides, and monomers. These vulcanizing agents can be used singly or in combination of two or more of them. As the sulfur-based vulcanizing agent, it is possible to list powdery sulfur, organic sulfur-containing compounds such as tetramethylthiuram disulfide, N,N-dithiobismorpholine. As the thiourea-based vulcanizing agent, it is possible to list tetramethylthiourea, trimethylthiourea, ethylenethiourea, and thioureas shown by $(C_nH_{2n+1}NH)_2C{=}S$ (n=integers 1 to 10). As the peroxides, benzoyl peroxide is exemplified.

The mixing amount of the vulcanizing agent for 100 parts by mass of the rubber component is set to favorably not less than 0.2 parts by mass nor more than five parts by mass and more favorably not less than one nor more than three parts by mass.

In the present invention, it is preferable to use sulfur and thioureas in combination as the vulcanizing agent.

The mixing amount of the sulfur for 100 parts by mass of the rubber component is set to favorably not less than 0.1 parts by mass nor more than 5.0 parts by mass and more favorably not less than 0.2 parts by mass nor more than 2 parts by mass. When the mixing amount of the sulfur for 100 parts by mass of the rubber component is less than 0.1 parts by mass, the vulcanizing speed of the entire rubber composition is slow and thus the productivity thereof is low. On the other hand, when the mixing amount of the sulfur for 100 parts by mass of the rubber component is more than 5.0 parts by mass, there is a possibility that the compression set of the rubber composition is high and the sulfur and an accelerating agent bloom.

The mixing amount of the thioureas for 100 g of the rubber component is set to favorably not less than 0.0001 mol nor more than 0.0800 mol, more favorably not less than 0.0009 mol nor more than 0.0800 mol, and most favorably not less than 0.0015 mol nor more than 0.0400 mol. By mixing the thioureas with the rubber component in the above-described mixing range, blooming and the contamination of the other members hardly occur, and further molecular motion of the rubber is little prevented. Thus the rubber composition is allowed to have a low electric resistance. As the crosslinking density becomes higher by increasing the addition amount of the thioureas, the electric resistance value of the rubber composition can be decreased to a higher extent. That is, when the mixing amount of the thioureas for 100 g of the rubber component is less than 0.0001 mol, it is difficult to improve the compression set of the rubber composition. To effectively decrease the electric resistance value, it is preferable that the mixing amount of the thioureas for 100 g of the rubber component is not less than 0.0009 mol. On the other hand, when the mixing amount of the thioureas for 100 g of the rubber component is more than 0.0800 mol, thioureas bloom from the surface of the rubber composition, thus contaminating the other components such as the photosensitive drum and deteriorating the mechanical properties of the rubber composition such as the breaking extension and the like thereof to a high extent.

In dependence on the kind of the vulcanizing agent, a vulcanizing accelerating agent or a vulcanizing accelerating assistant may be added to the rubber component.

As the vulcanizing accelerating agent, it is possible to use inorganic accelerating agents such as slaked lime, magnesia (MgO), and litharge (PbO); and organic accelerating agents shown below. The organic accelerating agent includes guanidines such as di-ortho-tolylguanidine, 1,3-diphenyl guanidine, 1-ortho-tolylbiguanide, the di-ortho-tolylguanidine salts of dicatechol borate; thiazoles such as 2-melcaptobenzothiazole, dibenzothiazolyl disulfide; sulfinamides such as N-cyclohexyl-2-benzothiazolylsulfinamide; thiurams such as tetramethylthiuram monosulfide, tetramethylthiuram disulfide, tetraethylthiuram disulfide, and dipentamethylenethiuram tetrasulfide; and thioureas. It is possible to use the above-described organic accelerating agents singly or in combination.

The mixing amount of the vulcanizing accelerating agent for 100 parts by mass of the rubber component is set to favorably not less than 0.5 nor more than five parts by mass and more favorably not less than 0.5 nor more than two parts by mass.

The following vulcanizing accelerating assistants can be used: metal oxides such as zinc white; fatty acids such as stearic acid, oleic acid, cotton seed fatty acid, and the like; and known vulcanizing accelerating assistants.

The addition amount of the vulcanizing accelerating assistant for 100 parts by mass of the rubber component is set to favorably not less than 0.5 parts by mass nor more than 10 parts by mass and more favorably not less than two parts by mass nor more than eight parts by mass.

When the rubber component (A) contains rubber containing chlorine atoms, it is preferable to add an acid-accepting agent to the rubber component (A). In this case, it is possible to prevent remaining of a chlorine gas generated when the rubber is vulcanized and the other members from being contaminated.

As the acid-accepting agent, it is possible to use various substances acting as acid acceptors. As the acid-accepting agent, hydrotalcites or magnesium oxide can be favorably used because they have preferable dispersibility. The hydrotalcites are especially favorable. By using the hydrotalcites in combination with a magnesium oxide or a potassium oxide, it is possible to obtain a high acid-accepting effect and securely prevent the other members from being contaminated.

The mixing amount of the acid-accepting agent for 100 parts by mass of the rubber component is set to favorably not less than 1 nor more than 10 parts by mass and more favorably not less than three nor more than seven parts by mass. The mixing amount of the acid-accepting agent for 100 parts by mass of the rubber component is set to favorably not less than one part by mass to allow the acid-accepting agent to effectively display the effect of preventing inhibition of vulcanization and the other members from being contaminated. The mixing amount of the acid-accepting agent for 100 parts by mass of the rubber component is set to favorably not more than 10 parts by mass to prevent an increase of the hardness of the vulcanized rubber composition.

In addition to the above-described components, the rubber composition may appropriately contain the following additives unless the use thereof is not contradictory to the object of the present invention: Additives other than the above-described components, a softening agent, a deterioration prevention agent, a filler, a scorch retarder, an ultraviolet ray absorber, a lubricant, a pigment, an antistatic agent, a fire retarding agent, a neutralizing agent, a core-forming agent, a foaming agent, a foam prevention agent, and a crosslinking agent. But it is preferable that the rubber composition does not contain the softening agent to prevent the toner and other members such as the photosensitive drum from being contaminated by bleeding. When the rubber composition contains an antioxidant, it is preferable to appropriately select the mixing amount thereof to allow the progress of the formation of the oxide film to be formed on the surface of the toner transport part.

The method of producing the conductive roller 10 shown in FIG. 1 is described below.

After components to be contained in the vulcanized rubber composition are kneaded by using a mixing apparatus such as a kneader, a roller, a Banbury mixer or the like, the components are preformed tubularly by using a rubber extruder. Thereafter the perform is vulcanized.

An optimum vulcanizing time period should be set by using a vulcanization testing rheometer (for example, Curelasto meter). To prevent the conductive roller from contaminating the other members and decrease the degree of the compression set, it is preferable to set conditions in which a possible largest vulcanization amount is obtained. More specifically, the vulcanization temperature is set to favorably 100 to 220° C. and more favorably 120 to 180° C. The vulcanization time period is set to favorably 15 to 120 minutes and more favorably 30 to 90 minutes.

After the step of vulcanizing the preform finishes, the core 2 is inserted into the hollow portion of the preform and bonded thereto. After the preform is cut to a necessary size, the surface of the toner transport part 1 is abraded to a mirror-like surface finish. The surface roughness Rz of the abraded toner transport part 1 is set to 0.1 to 3.0 μm.

After the roller is abraded, the roller is washed with water. Thereafter an oxide film is formed on the surface of the toner transport part 1 as desired. In forming the oxide film, the surface of the roller is irradiated with ultraviolet rays (wavelength: 184.9 nm and 253.7 nm) at intervals of 90 degrees in the circumferential direction of the roller for five minutes with an ultraviolet ray irradiation lamp spaced at 10 cm from the roller. The roller is rotated by 90 degrees four times to form the oxide film on the entire peripheral surface (360 degrees) of the roller.

It is preferable that the conductive roller 10 of the present invention produced in the above-described method has the following properties.

The electric resistance value of the conductive roller in environment having a temperature of 23° C. and a relative humidity of 55% is set to favorably $10^2\Omega$ to $10^7\Omega$ and more favorably $10^3\Omega$ to $10^7\Omega$, when a voltage of 5V is applied thereto.

The hardness of the conductive roller is favorably 20 to 80 degrees, more favorably 40 to 80 degrees, and most favorably 50 to 80 degrees when the hardness thereof is measured in the durometer hardness test type A described in JIS K 6253. The softer the conductive roller is, the larger the nip is. Consequently transfer, electric charging, and development can be efficiently accomplished. In addition, when the conductive roller has a hardness in the above-described range, it is possible to decrease mechanical damage to other members such as the photosensitive drum. When the hardness of the conductive roller is lower than 20 degrees, the wear resistance thereof is very low.

After 1% print was performed on 100 sheets of paper, a black solid image was printed thereon. It is preferable that as the index of an initial print density, transmission densitys on the obtained sheets are not less than 1.8 nor more than 2.1

It is preferable that a density change rate is not less than 95% nor more than 105%.

It is preferable that a toner transport amount is less than 0.49 mg/cm$^2$

It is preferable that the number of sheets where a defective image was generated is not less than 13,000.

Methods of measuring the transmission density and the like are as described in the examples described later.

EXAMPLES 1 THROUGH 12 AND COMPARISON EXAMPLES 1 THROUGH 7

The components (numerical values shown in table 1 indicate part by mass) shown in table 1, 0.75 parts by mass of powdery sulfur serving as a vulcanizing agent, 0.75 parts by mass of ethylene thiourea ("Axel 22-S" produced by Kawaguchi Chemical Industry Co., Ltd.), and six parts by mass of hydrotalcite ("DHT-4A-2" produced by Kyowa Chemical Industry Co., Ltd.) serving as an acid-accepting agent were kneaded by using a Banbury mixer. Thereafter the kneaded components were extruded by a rubber extruder to obtain a tube of each of the examples and the comparison examples having an outer diameter of ϕ22 mm and an inner diameter of ϕ9 mm to ϕ9.5 mm. Each tube was mounted on a shaft having a diameter of ϕ8 mm for vulcanizing use. After the rubber component was vulcanized in a vulcanizing can for one hour at 160° C., the tube was mounted on a shaft, having a diameter of ϕ10 mm, to which a conductive adhesive agent was applied. The tube and the shaft were bonded to each other in an oven at 160° C. After the ends of the tube were cut, traverse abrasion was carried out by using a cylindrical abrading machine. Thereafter the surface of the tube was abraded to a mirror-like surface finish. The surface roughness Rz of the tube was set to the range of 3 to 5 μm. The surface roughness Rz was measured in accordance with JIS B 0601 (1994). As a result, a conductive roller of each of the example and the comparison example having a diameter of ϕ20 mm (tolerance: 0.05) was obtained.

After the surface of each of the conductive rollers was washed with water, the surface thereof was irradiated with ultraviolet rays except the example 12 to form an oxide film thereon. By using an ultraviolet ray irradiation lamp ("PL21-200" produced by Sen Lights Corporation), the surface of each conductive roller was irradiated with ultraviolet rays (wavelength: 184.9 nm and 253.7 nm) at intervals of 90 degrees in its circumferential direction for five minutes with the ultraviolet ray irradiation lamp spaced at 10 cm from the conductive roller. The conductive roller was rotated by 90 degrees four times to form the oxide film on its entire peripheral surface (360 degrees).

As the components of the conductive roller of each of the examples and the comparison examples, the following substances were used:

(a) Rubber Component

Chloroprene rubber (CR): "Showprene WRT" produced by Showa Denko K.K.

Epichlorohydrin copolymer (GECO): "Epion ON301" produced by DAISO CO., LTD.

EO (ethylene oxide)/EP (epichlorohydrin)/AGE (allyl glycidyl ether)=73 mol %/23 mol %/4 mol %]

TABLE 1

| | | Comparison Example 1 | Comparison Example 2 | Comparison Example 3 | Example 1 | Example 2 | Example 3 | Example 4 | Example 5 | Example 6 |
|---|---|---|---|---|---|---|---|---|---|---|
| Chloroprene rubber | | 65 | 65 | 65 | 65 | 65 | 65 | 65 | 65 | 65 |
| Epichlorohydrin copolymer | | 35 | 35 | 35 | 35 | 35 | 35 | 35 | 35 | 35 |
| Acrylonitrile-butadiene rubber | | | | | | | | | | |
| Carbon black a (120 nm) | | 40 | 40 | | | | | | | |
| Carbon black b (35 nm) | | | | 10 | 5 | 10 | 15 | 20 | 25 | 35 |
| Carbon black c (13 nm) | | | | | | | | | | |
| Carbon black d (88 nm) | | | | | | | | | | |
| Titanium oxide | | | 10 | | 5 | 5 | 5 | 5 | 5 | 5 |
| Alumina | | | | | | | | | | |
| Silica | | | | | | | | | | |
| Oxide film of surface layer | | Formed | Formed | Formed | Formed | Formed | Formed | Formed | Formed | Formed |
| Electric resistance (logΩ) of roller | | 6.4 | 6.4 | 6.4 | 6.4 | 6.4 | 6.2 | 4.5 | 3.5 | Not more than 3 |
| Hardness | | 68 | 72 | 62 | 58 | 61 | 65 | 68 | 72 | 79 |
| Adhesion of toner | C100 | 1.79 | 1.81 | 1.95 | 1.90 | 1.92 | 1.96 | 1.95 | 1.96 | 1.95 |
| | | Δ | ○ | ◎ | ◎ | ◎ | ◎ | ◎ | ◎ | ◎ |
| | C2000 | 1.69 | 1.81 | 1.83 | 1.85 | 1.9 | 1.93 | 1.94 | 1.95 | 1.94 |
| | Density change rate (%) | 94 | 100 | 94 | 97 | 99 | 98 | 99 | 99 | 99 |
| | | Δ | ◎ | Δ | ○ | ◎ | ◎ | ◎ | ◎ | ◎ |
| Toner transport amount (mg/cm$^2$) | | 0.50 | 0.42 | 0.62 | 0.44 | 0.42 | 0.34 | 0.34 | 0.34 | 0.41 |
| | | Δ | ○ | X | ○ | ○ | ◎ | ◎ | ◎ | ○ |
| Durability of image (number of sheets) | | 12000 | 11000 | 10000 | 12000 | 12000 | 13000 | 13500 | 13500 | 12500 |
| | | Δ | X | X | Δ | Δ | ○ | ○ | ○ | Δ |
| Synthetic evaluation | | Δ | X | X | ○ | ○ | ◎ | ◎ | ◎ | ○ |

TABLE 2

| | | Example 7 | Example 8 | Example 9 | Example 10 | Example 11 | Example 12 | Comparison Example 4 | Comparison Example 5 | Comparison Example 6 | Comparison Example 7 |
|---|---|---|---|---|---|---|---|---|---|---|---|
| Chloroprene rubber | | 65 | 65 | 65 | 65 | 65 | 65 | 65 | 65 | 65 | 65 |
| Epichlorohydrin copolymer | | 35 | 35 | 35 | 35 | 35 | | 35 | 35 | 35 | 35 |
| Acrylonitrile-butadiene rubber | | | | | | | 35 | | | | |
| Carbon black a (120 nm) | | | | | | | | | | | |
| Carbon black b (35 nm) | | 15 | 15 | 15 | 15 | 15 | 15 | 3 | 35 | | |
| Carbon black c (13 nm) | | | | | | | | | | 25 | |
| Carbon black d (88 nm) | | | | | | | | | | | 25 |
| Titanium oxide | | 1 | 2.5 | 15 | 25 | 40 | 5 | 5 | 28 | 5 | 5 |
| Alumina | | | | | | | | | | | |
| Silica | | | | | | | | | | | |
| Oxide film of surface layer | | Formed | Formed | Formed | Formed | Formed | Not Formed | Formed | Formed | Formed | Formed |
| Electric resistance (logΩ) of roller | | 6 | 5.9 | 6.1 | 6.2 | 6.3 | 5.9 | 6.4 | Not more than 3 | Not more than 3 | 6.4 |
| Hardness | | 63 | 64 | 69 | 71 | 76 | 64 | 58 | 85 | 80 | 67 |
| Adhesion of toner | C100 | 1.97 | 1.98 | 1.94 | 1.92 | 1.96 | 1.89 | 1.69 | 1.9 | 1.9 | 1.69 |
| | | ◎ | ◎ | ◎ | ◎ | ○ | ○ | X | ○ | ○ | X |
| | C2000 | 1.91 | 1.97 | 1.93 | 1.91 | 1.89 | 1.87 | 1.64 | 1.98 | 1.9 | 1.63 |
| | Density change rate (%) | 97 | 99 | 99 | 99 | 96 | 99 | 97 | 104 | 100 | 96 |
| | | ○ | ◎ | ◎ | ◎ | ○ | ◎ | ○ | ○ | ○ | ○ |
| Toner transport amount (mg/cm$^2$) | | 0.42 | 0.34 | 0.34 | 0.34 | 0.40 | 0.40 | 0.55 | 0.40 | 0.3-0.55 | 0.55 |
| | | ○ | ◎ | ◎ | ◎ | ○ | ○ | Δ | ○ | Non-uniform | Δ |
| Durability of image (number of sheets) | | 12500 | 13500 | 13500 | 13500 | 12500 | 13000 | 11000 | 9000 | 9000 | 11000 |
| | | Δ | ○ | ○ | ○ | Δ | ○ | X | X | X | X |
| Synthetic evaluation | | ○ | ◎ | ◎ | ◎ | ○ | ○ | X | X | X | X |

Acrylonitrile-butadiene rubber (NBR): "Nipporu 401LL" produced by Zeon Corporation (b) Carbon Black Carbon black a: "Asahi #8" produced by Asahi Carbon Co., Ltd. (particle diameter: 120 nm)

Carbon black b: "Denkablack" produced by Denki Kagaku Kogyo K.K. (particle diameter: 35 nm)

Carbon black c: "Sunblack 930" produced by Asahi Carbon Co., Ltd. (particle diameter: 13 nm)

Carbon black d: "Niteron HTC#S" produced by Shin Nippon Carbon Co., Ltd. (average particle diameter: 88 nm)

(c) Inorganic Filler

Titanium oxide: "kronos KR310" produced by Titan Kogyo K.K.

Alumina: "AL-160SG-1" produced by Showa Denko K.K.

Silica: "VN3#" produced by Tosoh Silica Corporation

The following properties of the conductive roller of each of the examples and the comparison examples were measured. Results are shown in the tables.

<Measurement of Electric Resistance of Conductive Roller>

To measure the electric resistance of each roller, as shown in FIG. 2, the toner transport part 1 through which the core 2 was inserted was mounted on an aluminum drum 13, with the toner transport part 1 in contact with the aluminum drum 13. A leading end of a conductor having an internal electric resistance of r (100Ω) connected to a positive side of a power source 14 was connected to one end surface of the aluminum drum 13. A leading end of a conductor connected to a negative side of the power source 14 was connected to one end surface of the toner transport part 1, which was disposed opposite to the one end surface of the aluminum drum 3.

A voltage V applied to the internal electric resistance r of the conductor was detected. Supposing that a voltage applied to the apparatus is E, the electric resistance R of the roller is: $R=r\times E/(V-r)$. Because the term $-r$ is regarded as being extremely small, $R=r\times E/V$. A load F of 500 g was applied to both ends of the core 2. A voltage E of 5V was applied to the roller, while it was being rotated at 30 rpm. The detected voltage V was measured at 100 times during four seconds. The electric resistance value R was computed by using the above equation. The electric resistance value of each roller was measured at a constant temperature of 23° C. and a constant relative humidity of 55%.

The electric resistance value of each roller is shown as a logarithmic value in table 1.

<Hardness>

The hardness of each conductive roller in the durometer hardness test type A was measured in the method described in JIS K 6253.

<Evaluation of Adhesion of Toner>

To examine the adhesion of toner to the conductive roller, the conductive roller of each of the examples and the comparison examples was mounted on a laser printer (commercially available printer in which the positively charged unmagnetic one-component toner was used, print speed: 24 sheets/minute, recommended number of sheets which can be printed with toner: 7000 sheets) as a developing roller. The performance of each conductive roller was evaluated in terms of a change in the amount of toner outputted as an image. That is, the performance of each conductive roller was evaluated by using a change of the amount of the toner deposited on printed sheets as an index. The amount of the toner deposited on the printed sheets can be measured by measuring a transmission density shown below.

More specifically, after 1% printing was performed on 100 sheets of paper, black solid images was printed. The transmission density was measured by using a reflection transmission densitometer (densitometer "Techkon RT120/light plate LP20" produced by TECHKON Co., Ltd.) at given five points on each of the obtained printed sheets. The average of measured transmission densities was set as an initial density (indicated as C100 in the tables). Developing rollers which caused the initial density to be less than 1.7 were marked by x because the initial density was thin. Developing rollers which caused the initial density to be not less than 1.7 and less than 1.8 were marked by Δ because the initial density was thin, but in this range, the developing rollers can be used. Developing rollers which caused the initial density to be not less than 1.8 and less than 1.9 were marked by ○ because the initial density was comparatively thin, but was favorable. Developing rollers which caused the initial density to be not less than 1.9 and less than 2.0 were marked by ◎ because the initial density was optimum. Developing rollers which caused the initial density to be not less than 2.0 nor more than 2.1 were marked by ○ because the initial density was comparatively thick, but was favorable.

The transmission density was also measured on the black solid image printed after 1% printing was performed on 2000 sheets of paper. The average of measured transmission densities was set as the evaluation value (indicated as C2000 in the tables). The reason the transmission density was measured after printing was performed on 2000 sheets of paper is because normally a pre-conditioning interim operation finishes when printing is performed on 2000 sheets of paper.

The density change rate was computed from obtained values.

$$\text{Density change rate}(\%)=C2000/C100$$

Developing rollers which caused the density change rate to be less than 90% were marked by x. Developing rollers which caused the density change rate to be not less than 90% and less than 95% were marked by Δ. Developing rollers which caused the density change rate to be not less than 95% and less than 98% were marked by ○. Developing rollers which caused the density change rate to be not less than 98% and less than 102% were marked by ◎. Developing rollers which caused the density change rate to be not less than 102% nor more than 105% were marked by ○.

<Evaluation of Toner Transport Amount>

The toner transport amount was evaluated as described below by using an instrument for measuring the charged amount of toner to examine the relationship between the transmission density measured in the above-described manner and the toner transport performance.

More specifically, the black solid image was printed after 1% printing was performed on 100 sheets of paper in the above-described measurement. Thereafter a white solid image (blank) was printed on a 102nd sheet of paper. Thereafter a cartridge was removed from the laser printer to suck toner from the developing roller mounted on the cartridge by using a charged amount-measuring machine of an absorption type ("Q/M METER Model 210HS-2" produced by Trek Inc.) so that the charged amount (μC) and the weight of the toner was measured. Based on the following equation, the charged amount (μC/g) and the toner transport amount (mg/cm$^2$) were computed from obtained values.

$$\text{Toner charged amount}(\mu C/g)=\text{Charged amount}(\mu C)/\text{Weight of toner}(g)$$

$$\text{Toner transport amount}(mg/cm^2)=\text{Weight}(mg)\text{ of toner}/\text{Sucked area}(cm^2)$$

Developing rollers which caused the toner transport amount to be small were good. More specifically, developing rollers which caused the toner transport amount to be less than 0.39 mg/cm$^2$ were marked by ◎. Developing rollers veloping rollers which caused the toner transport amount to be not less than 0.39 mg/cm$^2$ and less than 0.49 mg/cm$^2$ were marked by ○. Developing rollers which caused the toner transport amount to be not less than 0.49 mg/cm$^2$ nor more than 0.59 mg/cm$^2$ were marked by Δ. developing rollers which caused the toner transport amount to be not less than 0.60 mg/cm$^2$ were marked by x.

<Evaluation of Durability of Image>

1% printing was performed to evaluate image durability. A predetermined image was printed after the printing had been performed on 500 sheets of paper. In this printing operation, a portion of some sheets of paper which should be printed in white started to become black because toner was applied thereto. These sheets of paper were recorded as sheets where a defective image was formed. The tables show the number of these sheets.

Developing rollers which caused the number of sheets of paper where the defective image was formed to be not more than 11,999 were marked by x. Developing rollers which caused the number of sheets of paper where the defective image was formed to be not less than 12,000 nor more than 12,999 were marked by Δ. Developing rollers which caused the number of sheets of paper where the defective image was formed to be not less than 13,000 nor more than 13,999 were marked by ○. Developing rollers which caused the number of sheets of paper where the defective image was formed to be not less than 14,000 were marked by ◎.

Figure 1:
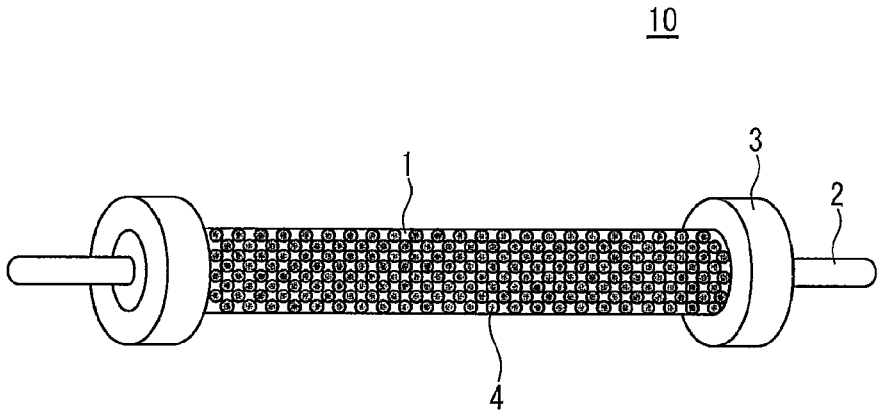
FIG. 1 is schematic view showing a conductive roller of the present invention.
Figure 2:
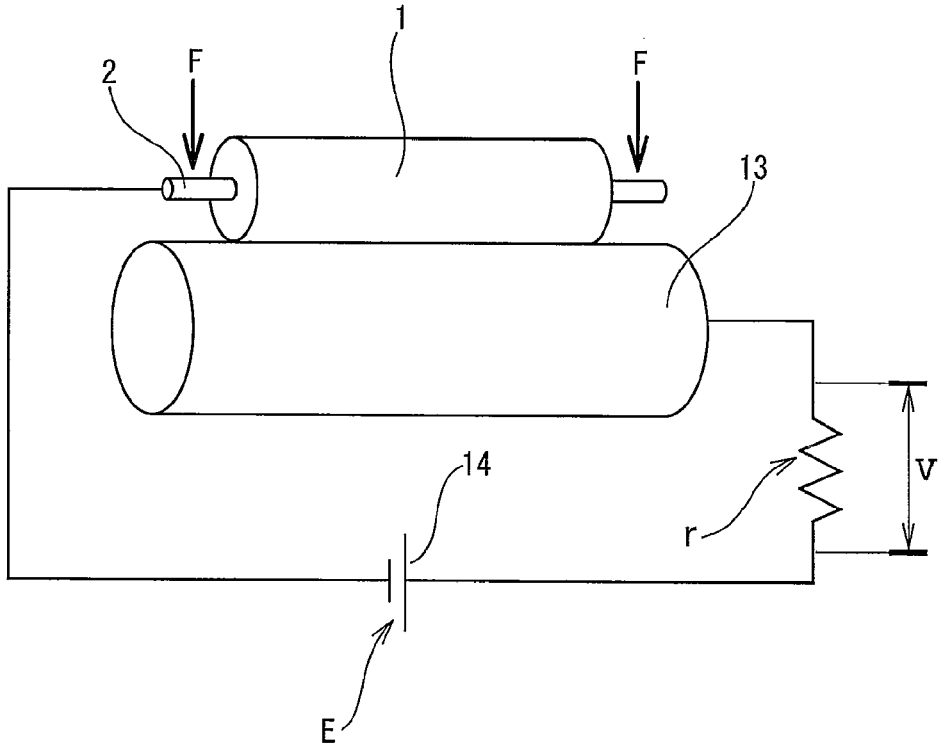
FIG. 2 shows a method of measuring an electric resistance of the conductive roller.

What is claimed is:

1. A conductive roller composed of one layer a toner transport part, and the toner transport part is composed of one layer made of a vulcanized rubber composition at least on an outermost layer thereof, said vulcanized rubber composition containing a rubber component (A), highly conductive carbon black (B) having a particle diameter not less than 18 nm and less than 80 nm, an inorganic filler (C) consisting of not less than one kind of a metal oxide selected from among a group of titanium oxide, alumina and silica;

a total of a content of said highly conductive carbon black (B) and a content of said inorganic filler (C) for 100 parts by mass of said rubber component (A) is not less than 10 parts by mass nor more than 60 parts by mass;

the rubber component (A) contains a combination of chloroprene rubber and epichlorohydrin copolymer;

the content of the chloroprene rubber for 100 parts by mass of the rubber component (A) is set to 50 to 80 parts by mass; and the content of the epichlorohydrin copolymer for 100 parts by mass of the rubber component (A) is set to 20 to 50 parts by mass.

2. The conductive roller according to claim 1, wherein said vulcanized rubber composition contains not less than one part by mass nor more than 40 parts by mass of said highly conductive carbon black (B) and not less than one part by mass nor more than 40 parts by mass of said inorganic filler (C) for 100 parts by mass of said rubber component (A).

3. The conductive roller according to claim 1, wherein said vulcanized rubber composition contains not less than five parts by mass nor more than 30 parts by mass of said highly conductive carbon black (B) and not less than 10 parts by mass nor more than 40 parts by mass of said inorganic filler (C) for 100 parts by mass of said rubber component (A); and a total of a content of said highly conductive carbon black (B) and a content of said inorganic filler (C) for 100 parts by mass of said rubber component (A) is not less than 10 parts by mass nor more than 40 parts by mass.

4. The conductive roller according to claim 1, wherein said inorganic filler is titanium oxide.

5. The conductive roller according to claim 1, wherein said conductive roller is used as a developing roller for use in a developing device, using an unmagnetic one-component toner, which is mounted on an image-forming mechanism of an electrophotographic apparatus.

6. The conductive roller according to claim 1, wherein a cylindrical core is inserted into a hollow portion of said toner transport part by press fit; and an oxide film is formed on a surface of said toner transport part by irradiating said surface thereof with ultraviolet rays.

* * * * *